US010271629B1

(12) United States Patent
Nichol

(10) Patent No.: US 10,271,629 B1
(45) Date of Patent: Apr. 30, 2019

(54) COSMETICS PORTIONING MACHINE

(71) Applicant: Equality Cosmetics, Inc., Wilmington, DE (US)

(72) Inventor: Jamie G. Nichol, Carlisle, MA (US)

(73) Assignee: EQUALITY COSMETICS, INC., Wilmington, DE (US)

( * ) Notice: Subject to any disclaimer, the term of this patent is extended or adjusted under 35 U.S.C. 154(b) by 0 days.

(21) Appl. No.: 15/991,486

(22) Filed: May 29, 2018

(51) Int. Cl.

| | |
|---|---|
| ***B01F 15/02*** | (2006.01) |
| ***A45D 40/24*** | (2006.01) |
| ***B05C 17/005*** | (2006.01) |
| ***B65D 81/32*** | (2006.01) |
| ***A45D 40/00*** | (2006.01) |
| *B01F 13/00* | (2006.01) |
| *A45D 34/04* | (2006.01) |

(52) U.S. Cl.
CPC ..... *A45D 40/24* (2013.01); *A45D 40/0075* (2013.01); *B05C 17/00566* (2013.01); *B65D 81/325* (2013.01); *A45D 34/04* (2013.01); *A45D 2200/055* (2013.01); *A45D 2200/058* (2013.01); *B01F 13/002* (2013.01); *B01F 15/0237* (2013.01); *B01F 2215/0031* (2013.01); *B05C 17/00556* (2013.01); *B05C 17/00563* (2013.01); *B05C 17/00569* (2013.01)

(58) Field of Classification Search
CPC ..... A45D 40/24; A45D 40/0075; A45D 17/00566; B05C 17/00566; B65D 81/325
USPC ..... 222/146.1, 146.2, 146.5, 309, 402.11, 222/402.14, 547, 549, 559; 366/160.4, 366/189, 195, 273, 333
See application file for complete search history.

(56) References Cited

U.S. PATENT DOCUMENTS

| | | | | |
|---|---|---|---|---|
| 3,370,754 | A * | 2/1968 | Schumann | A61C 9/0026 222/132 |
| 3,739,947 | A | 6/1973 | Baumann et al. | |
| 5,094,276 | A * | 3/1992 | Caputo | B01F 5/08 141/9 |
| 5,163,010 | A | 11/1992 | Klein et al. | |
| 5,316,712 | A | 5/1994 | Ono et al. | |
| 5,622,692 | A | 4/1997 | Rigg et al. | |
| 6,402,364 | B1 | 6/2002 | Esclar et al. | |
| 6,412,658 | B1 | 7/2002 | Bartholomew et al. | |
| D461,080 | S | 8/2002 | Bartholomew et al. | |
| D465,810 | S | 11/2002 | Bartholomew et al. | |
| 6,510,366 | B1 | 1/2003 | Murray et al. | |
| 6,516,245 | B1 | 2/2003 | Dirksing et al. | |
| 6,615,881 | B2 | 9/2003 | Bartholomew et al. | |
| 6,622,064 | B2 | 9/2003 | Bartholomew et al. | |
| 6,655,551 | B2 | 12/2003 | Manne | |

(Continued)

*Primary Examiner* — Vishal Pancholi
(74) *Attorney, Agent, or Firm* — Nutter McClennen & Fish LLP

(57) ABSTRACT

A cosmetic portioning machine is provided having a mixing chamber, with a plurality of inlets each of which provides an ingredient. A piston disposed in the mixing chamber to define a mixing volume. A dasher is disposed in the mixing chamber and mixes the ingredients together in the mixing volume so as to form a cosmetic. When the cosmetic product is thoroughly mixed, the piston urges the product out of the mixing chamber and through an outlet. A moveable sealing member is configured to pass through the outlet so as to seal off fluid communication between the mixing chamber and the outlet and to urge any remaining cosmetic product through the outlet.

14 Claims, 7 Drawing Sheets

(56) References Cited

U.S. PATENT DOCUMENTS

D485,310 S 1/2004 Bartholomew et al.
6,672,341 B2 1/2004 Bartholomew et al.
6,779,686 B2 8/2004 Bartholomew et al.
D500,804 S 1/2005 Bartholomew et al.
6,883,561 B2 4/2005 Bartholomew et al.
6,935,386 B2 8/2005 Miller et al.
D513,040 S 12/2005 Bartholomew et al.
7,082,970 B2 8/2006 Bartholomew et al.
7,099,740 B2 8/2006 Bartholomew et al.
7,121,429 B2 10/2006 Bartholomew et al.
7,174,310 B2 2/2007 Bartholomew et al.
7,395,134 B2 7/2008 Bartholomew et al.
7,445,372 B1 11/2008 Engel et al.
7,475,710 B2 1/2009 Bartholomew et al.
7,624,769 B2 12/2009 Bartholomew et al.
7,822,504 B2 10/2010 Bartholomew et al.
8,017,137 B2 9/2011 Bartholomew
8,141,596 B2 3/2012 Bartholomew et al.
8,186,872 B2 5/2012 Bartholomew et al.
8,352,070 B2 1/2013 Bartholomew et al.
8,564,778 B1 10/2013 Igarashi
8,573,263 B2 11/2013 Bartholomew et al.
8,593,634 B1 11/2013 Igarashi
8,608,371 B2 12/2013 Bartholomew et al.
8,636,173 B2 1/2014 Bartholomew et al.
8,830,467 B2 9/2014 Igarashi
8,830,468 B2 9/2014 Igarashi
8,880,218 B2 11/2014 Bartholomew et al.
9,007,588 B1 4/2015 Igarashi
9,442,494 B2 9/2016 Igarashi
9,452,279 B2 * 9/2016 Stevens ..... A61M 25/10182
9,858,685 B2 * 1/2018 Nichol ..... G06T 7/90
2001/0047309 A1 11/2001 Bartholomew et al.
2002/0179639 A1 12/2002 Bartholomew et al.
2003/0090176 A1 5/2003 Bartholomew et al.
2004/0078278 A1 4/2004 Dauga et al.
2006/0000852 A1 1/2006 Manne
2006/0124196 A1 6/2006 Bartholomew et al.
2007/0035815 A1 2/2007 Edgar et al.
2008/0311061 A1 12/2008 Heuer
2010/0181340 A1 7/2010 Wallace et al.
2010/0284245 A1 11/2010 McNicol et al.
2011/0226803 A1 9/2011 Schwartz
2011/0247718 A1 10/2011 Samain
2011/0288680 A1 11/2011 Samain et al.
2011/0304877 A1 12/2011 Bitoh
2012/0152406 A1 6/2012 Bartholomew et al.
2013/0123973 A1 5/2013 Saranow et al.
2014/0050635 A1 2/2014 Azzi et al.
2014/0081462 A1 3/2014 Igarashi
2014/0081463 A1 3/2014 Igarashi
2014/0082854 A1 3/2014 Landa et al.
2014/0094964 A1 4/2014 Bartholomew et al.
2014/0311625 A1 10/2014 Bartholomew et al.
2015/0021356 A1 1/2015 Witchell et al.
2015/0314141 A1 11/2015 Choi
2015/0356661 A1 12/2015 Rousay
2016/0015152 A1 1/2016 Ajiki et al.
2016/0022972 A1 1/2016 Rabe et al.
2016/0082403 A1 3/2016 Ounzar
2016/0107133 A1 4/2016 Sugino et al.
2016/0184566 A1 6/2016 Ibrahim et al.
2016/0270511 A1 * 9/2016 Wee ..... A45D 40/24
2016/0361526 A1 12/2016 Rabe et al.
2017/0228892 A1 8/2017 Nichol et al.

* cited by examiner

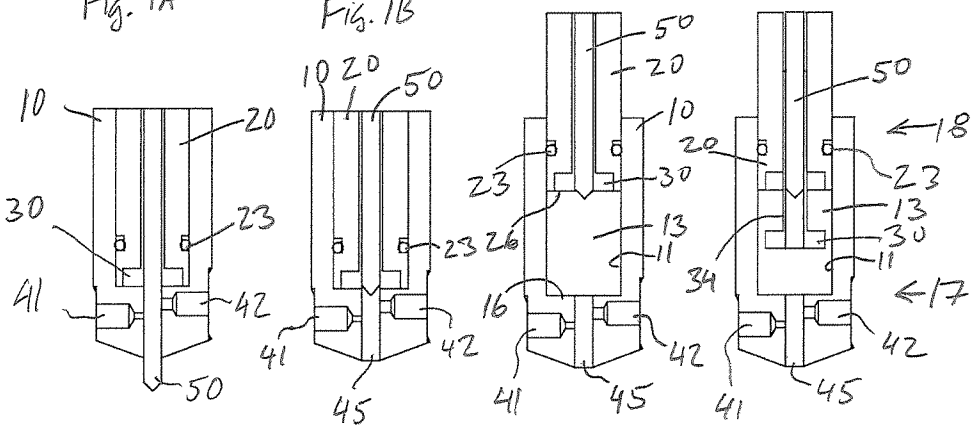
Fig. 1A
Fig. 1B
Fig. 1C
Fig. 1D
10
20
23
30
41
42
45
50
13
11
16
26
34
17
18
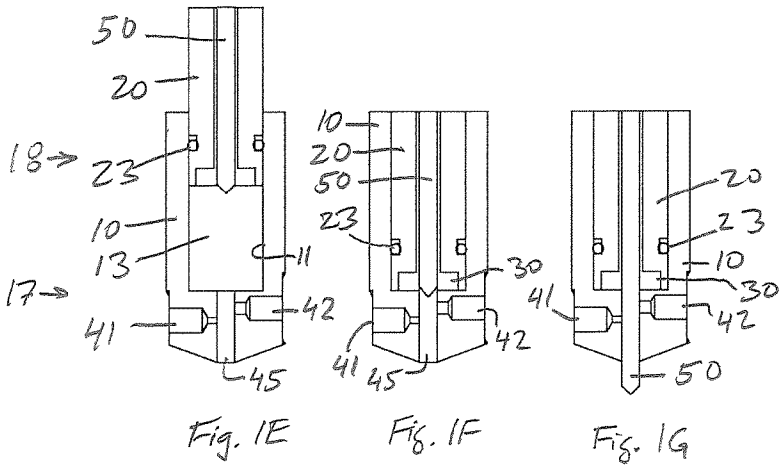
Fig. 1E
Fig. 1F
Fig. 1G
10
20
23
30
41
42
45
50
13
11
17
18

130
120
110
143
145
17
150
18

17
111
113
132
18
145
110
130
120
150

113
130
120
145
111
110
150

130
120
110
150
145
163
150
17
132
111
18
145
130
113
120

130
120
110
143
17
150
18

COSMETICS PORTIONING MACHINE

TECHNICAL FIELD

The present invention relates to cosmetics, and more particularly to systems for mixing ingredients to create a cosmetic that is customized for a customer and for dispensing the cosmetic.

SUMMARY OF THE EMBODIMENTS

In accordance with one embodiment of the invention, a cosmetic portioning machine is provided having a mixing chamber, with a plurality of inlets each of which provides an ingredient. A piston is disposed in the mixing chamber to define a mixing volume. A dasher is disposed in the mixing chamber and mixes the ingredients together in the mixing volume so as to form a cosmetic. When the cosmetic product is thoroughly mixed, the piston urges the product out of the mixing chamber and through an outlet. A moveable sealing member is configured to pass through the outlet so as to seal off fluid communication between the mixing chamber and the outlet and to urge any remaining cosmetic product through the outlet.

The volume of the mixing chamber is adjustable from cycle to cycle, so that samples of different sizes may be dispensed. For example, in one embodiment, the volume of the mixing chamber can be set from 3 microliters to 10 milliliters. Also, cycles can be repeated to dispense multiples of the mixing volume. For example, to dispense 15 mL of product, the system may repeat a cycle twice, wherein each cycle mixes and dispenses 7.5 mL of product.

In a preferred embodiment, the portioning machine includes a mixing chamber, the mixing chamber having a longitudinal axis and an inner perimeter wall extending parallel to the longitudinal axis. Along this longitudinal axis, the mixing chamber has a distal end and a proximal end. The machine also includes a first inlet for providing the first ingredient, the first inlet being in fluid communication with the mixing chamber. The machine also includes a second inlet for providing the second ingredient, the second inlet being in fluid communication with the mixing chamber. The machine also includes an outlet in fluid communication with the mixing chamber. A piston is disposed in the mixing chamber and configured to move towards and away from the proximal end, the piston having a face extending transversely with respect to the longitudinal axis and being substantially in contact with the inner perimeter wall, such that the piston and the inner perimeter wall define a volume, and the face preventing flow of fluid therethrough into or out of the volume. A dasher is disposed in the mixing chamber and configured to move towards and away from the proximal end in the volume. The dasher is configured to mix fluid in the volume and to permit the passage of fluid past the proximal end of the dasher. A moveable sealing member is also provided and is configured to pass through the outlet so as to seal off fluid communication between the mixing chamber and the outlet and to urge fluid through the outlet.

The dasher, in a preferred embodiment defines an opening through which fluid may flow from one side of the dasher to the other side of the dasher in the volume. The dasher preferably extends transversely with respect to the longitudinal axis and is substantially in contact with the inner perimeter wall, so that a seal is formed between the dasher and the inner perimeter wall and fluid is forced to flow through the opening as the dasher moves in the volume towards and away from the proximal end. In alternative embodiment of the dasher, the dasher includes one or more additional openings.

In the preferred embodiment, the moveable sealing member moves transversely to the longitudinal axis of the mixing chamber and is located at the proximal end. Each of the dasher and the piston are, in a preferred embodiment, concentrically disposed about the longitudinal axis, wherein the dasher includes an actuating rod that is disposed in an axial passage defined by the piston. The piston moves in a distal direction to increase the mixing volume and in a proximal direction to decrease the mixing volume. The first inlet, the second inlet and the outlet are preferably disposed adjacent the proximal end of the chamber. Additional inlets may be provided for additional ingredients.

In an alternative embodiment, the sealing member is disposed in the mixing chamber and is configured to move in the volume towards and away from the proximal end, so that the sealing member can seal off fluid communication between the mixing chamber and the inlets. In this embodiment, each of the sealing member, the dasher and the piston are preferably disposed concentrically about the longitudinal axis, wherein the sealing member is disposed inside of the dasher, and the dasher is disposed in the piston. As above, the piston moves in a distal direction to increase the mixing volume increases and in a proximal direction to decrease it. The inlets and the outlet are disposed adjacent the proximal end of the chamber. In this embodiment, the face of the piston is shaped so that the dasher can nest in the face and form a flat end wall in combination with the piston face.

A preferred method includes the steps of providing one of the portioning machines described above; moving the piston towards the distal end and simultaneously introducing the first and second ingredients from the first and second inlets respectively into the volume; moving the dasher in the volume so as to cause the mixing of the first and second ingredients in the volume; moving the sealing member so as to unseal the outlet; and moving the piston towards the proximal end so as to force the mixed first and second ingredients out of the outlet.

BRIEF DESCRIPTION OF THE DRAWINGS

The foregoing features of embodiments will be more readily understood by reference to the following detailed description, taken with reference to the accompanying drawings, in which:

FIGS. 1A-1G are sectional views of one embodiment of the invention as it cycles through the mixing and dispensing phases.

DETAILED DESCRIPTION OF SPECIFIC EMBODIMENTS

Figures 2A, 2B, 2C, 2D, 2E, 2F:
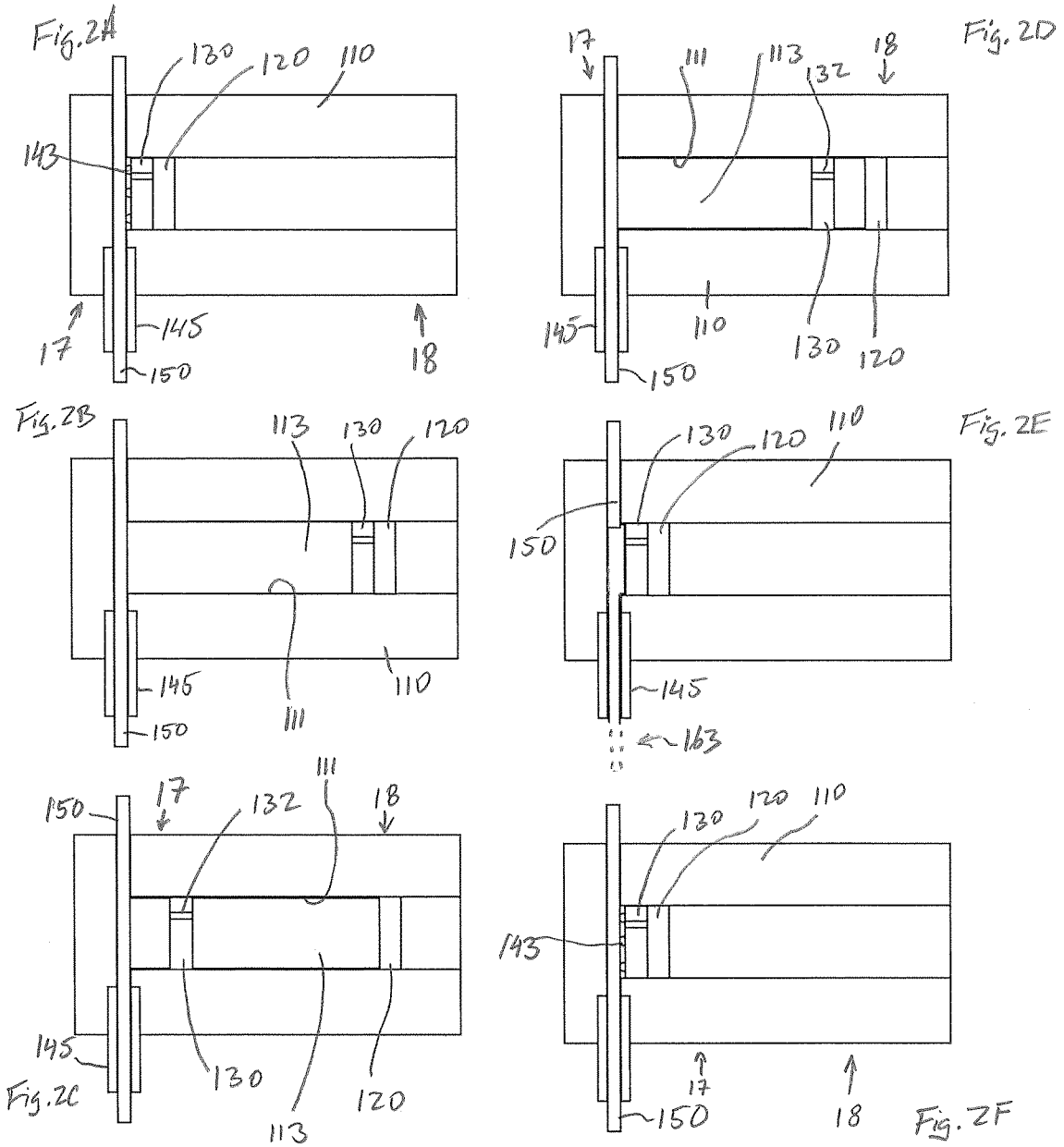
FIGS. 2A-2F are sectional (simplified) views of a preferred embodiment of the invention as it cycles through the mixing and dispensing phases.

In preferred embodiments, the mixing and dispensing system described herein may be used in cosmetic customization systems like those described in U.S. Pat. No. 9,858,685 issued Jan. 2, 2018 to Nichol et al. and assigned to Equality Cosmetics, Inc., which patent is incorporated herein by reference.

FIGS. 1A-1G show sectional views of one embodiment of the mixing and dispensing system as it cycles through the mixing and dispensing phases. A housing 10 is provided with radially disposed inlet ports 41 and 42, through which cosmetic additives are introduced for mixing in the mixing volume 13. Preferably, this mixing volume 13 is cylindrically shaped.

The inlet ports 41 and 42 are located at the proximal end 17 of the housing 10 near the outlet port 45. The inlet ports 41 and 42 are connected to different reservoirs (not shown) containing different ingredients. Depending on the number of different ingredients available for mixing, additional inlet ports (not shown) may also be provided and disposed in such a radial arrangement. Each reservoir has a pump associated therewith in order to urge the ingredient from the reservoir through the inlet port and into the mixing chamber. Also, it is preferred that a check valve, such as a ball check valve, be located between the reservoir and the corresponding inlet port, so that no fluid is forced into the inlet port from the mixing chamber.

Each of the inlet and outlet ports is in fluid communication with the mixing volume 13. By arranging the inlet ports radially around the housing 10 less longitudinal space is needed compared to a linear arrangement of ports. By using this radial arrangement of inlet ports and by sharing part of the fluid communication pathway with the outlet port 45 a smaller volume is provided in which ingredients may be retained between an inlet and the mixing volume 13. Different size inlet ports 41 and 42 may be used for the various cosmetic additives, e.g., larger-diameter ports for red, yellow, and white; and smaller-diameter ports for black and blue. Other types of additives that may be mixed into the cosmetic product include antioxidants, fragrances, and sun block ingredients.

Although FIGS. 1A-1G show the mixing and dispensing system oriented so that the outlet port 45 and the proximal end 17 are at the bottom, a preferred embodiment has the outlet port and the proximal end facing down, so that gravity assists in the dispensing of the fluid from the mixing chamber 13. Relatively high fluid viscosity and a relatively small nozzle diameter prevent the fluid from leaking from the outlet port 45 before the dispensing step. In another embodiment, the mixing and dispensing system is oriented so that the longitudinal axis of the mixing volume 13 is horizontal.

The mixing assembly includes a piston (or plunger) 20, a dasher 30, and a sealing pin 50 (or other type of sealing member). These three components—the piston 20, the dasher 30, and the sealing pin 50—are separately movable. Preferably, each of these components has its own actuator (not shown). The dasher 30 has an actuation rod 34 that fits within a central axial hole in the piston 20. The sealing pin 50 fits within a central axial hole of the dasher 30. When fully extended, the pin 50 blocks the outlet (or dispensing) port 45 through which the dispensed cosmetic is ejected. The pin 50 also blocks the cosmetic additive inlet ports 41 and 42.

Preferably, (as shown in FIG. 1C) the head of the dasher 30 fits within the face of the piston 20, so that the dasher 30 and the piston 20 form a substantial flat surface 26, so that when this flat surface 26 is pressed against the flat axial wall 16 the mixing volume is reduced to no volume or almost no volume. Alternatively, the surface 26 and the axial wall 16 are not flat but have complementary shapes so that when the piston 20 and the dasher 30 are moved to their greatest proximal extent the mixing volume 13 is reduced to no volume or almost no volume. Such arrangements of the surface 26 and the axial wall 16 minimize the amount of the finished cosmetic product left in the machine after the dispensing step.

The outer diameter of the piston 20 preferably creates a seal with the inner perimeter wall 11. A gasket 23 may be provided about the outer diameter of the piston 20 so as to improve this seal between the piston 20 and the inner perimeter wall 11. This gasket 23 is preferably made of material that can withstand both the chemicals and the abrasives (e.g., iron oxide) in the cosmetic additives. Alternative embodiments of the system may omit a gasket, but closer machining of the piston 20 and the inner perimeter wall 11 would be required.

Preferably, the sealing pin 50 has a uniform diameter along the working length of the pin, although alternative embodiments may have varying diameters. For example, the pin 50 may have larger diameter toward the dispensing port 45 and smaller diameter at the cosmetic additive ports 41 and 42 to allow cosmetic additives to be pumped into the mixing chamber 13 even when the pin 50 is extended.

FIG. 1A shows the system at the beginning of a mixing and dispensing cycle. The sealing pin 50 is extended through the outlet port 45, and the piston 20 and the dasher 30 are extended to their greatest extent in the proximal direction so as to minimize or eliminate the size of the mixing volume.

As shown in FIG. 1B, the sealing pin 50 is withdrawn from the outlet port 45 so as to unseal the inlet ports 41 and 42. In FIG. 1C, the sealing pin 50, along with the piston 20 and the dasher 30, are withdrawn further towards the distal end 18. A mixing volume 13 is thereby formed, defined (at least in part) by the inner perimeter wall 11, by the face 26 formed by the piston 20 and the dasher 30, and by the axial wall 16. During this step, the ingredients from the inlet ports 41 and 42 (and perhaps from other inlet ports not shown) are simultaneously introduced into the mixing volume 13 to minimize air entrainment.

In FIG. 1D, the dasher 30 is actuated back and forth within the mixing chamber 13 so as to thoroughly mix the ingredients and thereby form the final cosmetic product. After the mixing step, the dasher 30 is withdrawn towards the distal end 18 and into the face of the piston 20, as shown in FIG. 1E. At this point in the process, the mixing volume 13 is filled with the mixed ingredients that form the cosmetic product.

In FIG. 1F, the dasher 30, the piston 20 and the sealing pin 50 are urged towards the proximal end 17 so as to force the mixed cosmetic product through the outlet port 45. After the mixing volume is minimized, the sealing pin 50 continues moving towards the proximal end 17 and through the outlet port 45, as shown in FIG. 1G. By urging the sealing pin 50 though the outlet 45, the remaining cosmetic product is urged completely through the outlet port 45 and out of the system. It will be appreciated that the positions of the different components of the system at the end of the cycle, as shown in FIG. 1G, are identical to the positions at the beginning of the cycle, as shown in FIG. 1A. Thus, the cycle may be repeated, with the same proportions of ingredients, until the desired amount of the cosmetic product is dispensed. Accordingly, this system can produce small batches and large batches of cosmetics. If a different cosmetic product is desired (having a different color, for example) the cycle may be repeated several times with different ingredients and/or different proportions of ingredients.

FIGS. 2A-2F show a preferred embodiment of a mixing and dispensing system. Radially disposed inlet ports 143 are provided at the proximal end 17 of a cylindrical mixing volume 113, which is defined in part by the inner perimeter wall 111 of a housing 110. Cosmetic additives are introduced from reservoirs (not shown) through the inlet ports 143 for mixing in the mixing volume 113. Depending on the number of different ingredients available for mixing, additional inlet ports (not shown) may also be provided and disposed around the circumference of the mixing chamber 113 near the proximal end 17.

Also at the proximal end 17 of the housing 110 is an outlet port 145, which is oriented transversely to the longitudinal axis of the mixing volume 113. Each reservoir has a pump (not shown) for urging the ingredient from the reservoir through the inlet port and into the mixing chamber. Also, it is preferred that a check valve (not shown), such as a ball check valve, be located between the reservoir and the corresponding inlet port, so that no fluid is forced into the inlet port from the mixing chamber.

The mixing assembly includes a piston 120 and a dasher 130. A sealing pin 150 is oriented transversely to the longitudinal axis of the mixing chamber 113, so that it can pass through the outlet port 145. Preferably, the sealing pin 150 has a uniform diameter along its working length, so that the sealing pin 150 can force fluid all the way through the outlet port 145 as well as seal the outlet port 145 closed.

The piston 120, the dasher 130 and the sealing pin 150 are separately movable, each having its own actuator (not shown). The dasher 130 may have an actuation rod (not shown) that fits within a central axial hole in the piston 120.

Preferably, the dasher 130 includes a mixing hole 132 through which fluid may pass from one side of the dasher 130 to the other. The outer diameters of both the piston 120 and the dasher 130 preferably create seals with the inner perimeter wall 111. Gaskets (not shown) may be provided about the outer diameters of the piston 120 and the dasher 130 so as to improve the seals with the inner perimeter wall 111. These gaskets are preferably made of material that can withstand both the chemicals and the abrasives (e.g., iron oxide) in the cosmetic additives. Forming a seal between the inner perimeter wall 111 and the outer perimeter of the dasher 130 helps prevent an unmixed film of ingredients being left on the inner perimeter wall 111 after the mixing step. Thus, this seal (whether formed by a gasket or by close machining of parts) is important for a thorough, complete mixing of ingredients, resulting in an evenly colored cosmetic product.

Preferably, the size of the dasher's mixing hole 132 and the speed at which the dasher 130 is agitated during the mixing step are optimized so that turbulent flow in the liquid is created at just above the laminar-turbulent transition, for example at a Reynolds number just above 4000. Sufficient turbulence is desired in order to cause thorough mixing of the ingredients. The ingredients often take the form of multi-phase emulsions which have been carefully formed at manufacture. If too much, or too little power is transmitted to the emulsified ingredients, the emulsion may break down. These emulsions, which create desirable skin feel properties in the cosmetic product, are often fragile and unstable.

Since different ingredients may have very different viscosities, and since in many embodiments the size of the mixing opening 132 is fixed, an optimal mixing opening size and geometry is selected to work well over a range of ingredient viscosities. Meanwhile, the speed of the dasher during mixing can be selected for each mixing cycle—depending on the viscosities and the relative instabilities of the ingredients being used—so as to create a Reynolds number in a desired range. In alternative embodiments, more than one mixing hole 132 may be provided in the dasher 130.

FIG. 2A shows the system at the beginning of a mixing and dispensing cycle. The sealing pin 150 is extended through the outlet port 145, while the piston 120 and the dasher 130 are extended to their greatest extent in the proximal direction so as to minimize or eliminate the size of the mixing volume. In FIG. 2B, the sealing pin 150 is kept within the outlet port 145, while the ingredients are introduced into the mixing chamber 113 from the inlet ports 143. The pumping of the ingredients from the reservoirs through the inlet ports 143 into the mixing chamber 113 causes the piston 120 and the dasher 130 to be urged toward the distal end 18.

FIGS. 2B-2D show the mixing volume 113 filled with a fluid or fluids. (Since the mixing volume 113 is filled, the inlet ports 143 are blocked by fluid in views shown in FIGS. 2B-2D, and thus are not visible.) In FIG. 2B, when the chamber is initially filled, the ingredients are unmixed. During the mixing process, the product becomes more homogenized, until it is thoroughly mixed in FIG. 2D.

In FIGS. 2C and 2D, the sealing pin 150 is kept in the outlet port 150, while the dasher 130 is actuated back and forth within the mixing chamber 113 so as to thoroughly mix the ingredients and thereby form the final cosmetic product. After the mixing step, the sealing pin 150 is withdrawn from the outlet port 145, and the piston 120 is urged towards the proximal end 17 so as to force the mixed cosmetic product through the outlet port 145, as shown in FIG. 2E.

After the mixing volume is minimized, the sealing pin 150 is moved down through the outlet port 145, as shown in FIG. 2F. By urging the sealing pin 150 though the outlet 145, the remaining cosmetic product is urged completely through the outlet port 145 and out of the system. It will be appreciated that the positions of the different components of the system at the end of the cycle, as shown in FIG. 2F, are identical to the positions at the beginning of the cycle, as shown in FIG. 2A. The cycle may be repeated, with the same proportions of ingredients, until the desired amount of the cosmetic product is dispensed. Accordingly, this system can produce small batches and large batches of cosmetics. If a different cosmetic product is desired (having a different color, for example) the cycle may be repeated several times with different ingredients and/or different proportions of ingredients.

Figure 3A:
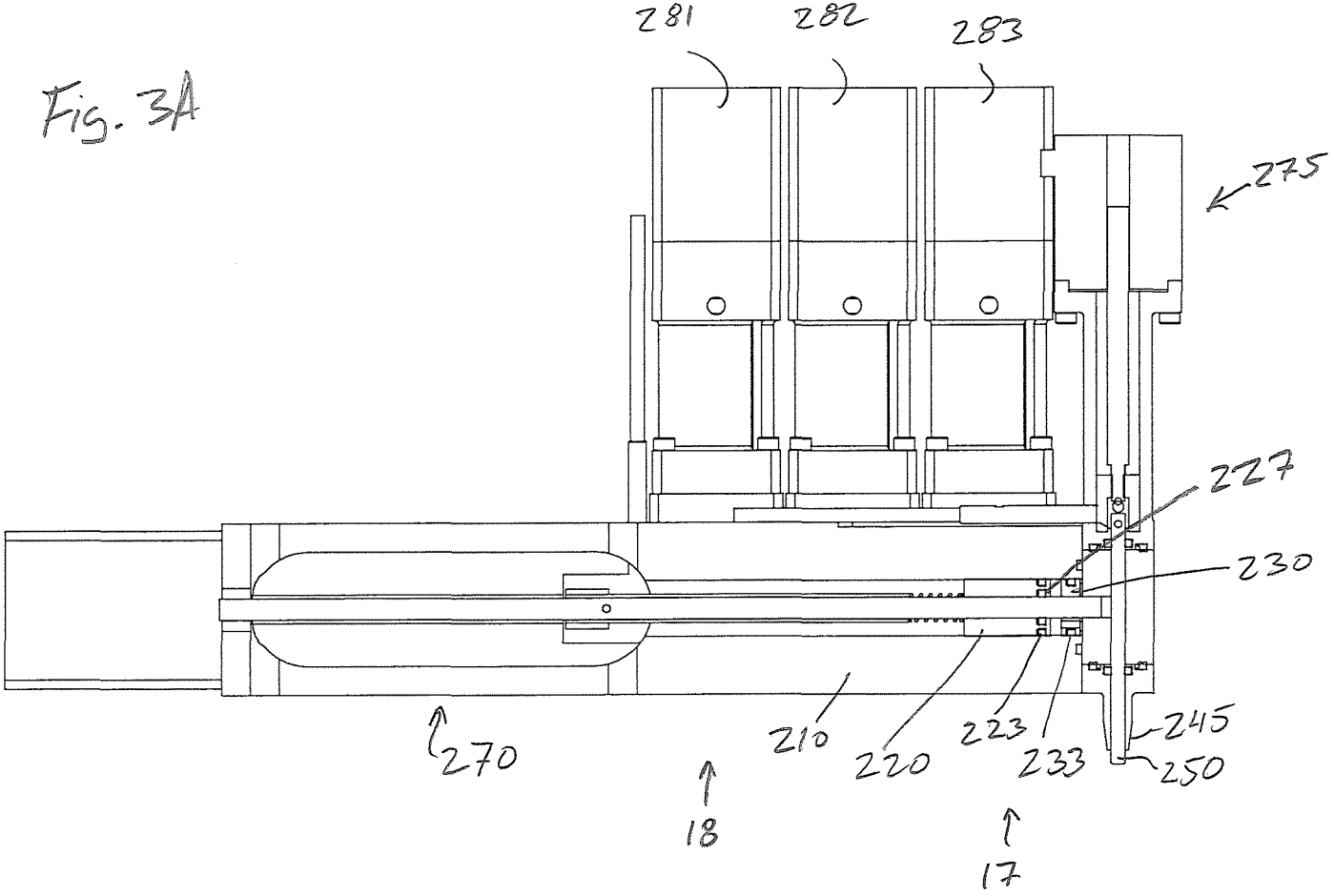
FIGS. 3A-3E are sectional views of a preferred embodiment of the invention as it cycles through the mixing and dispensing phases.
Figure 3B:
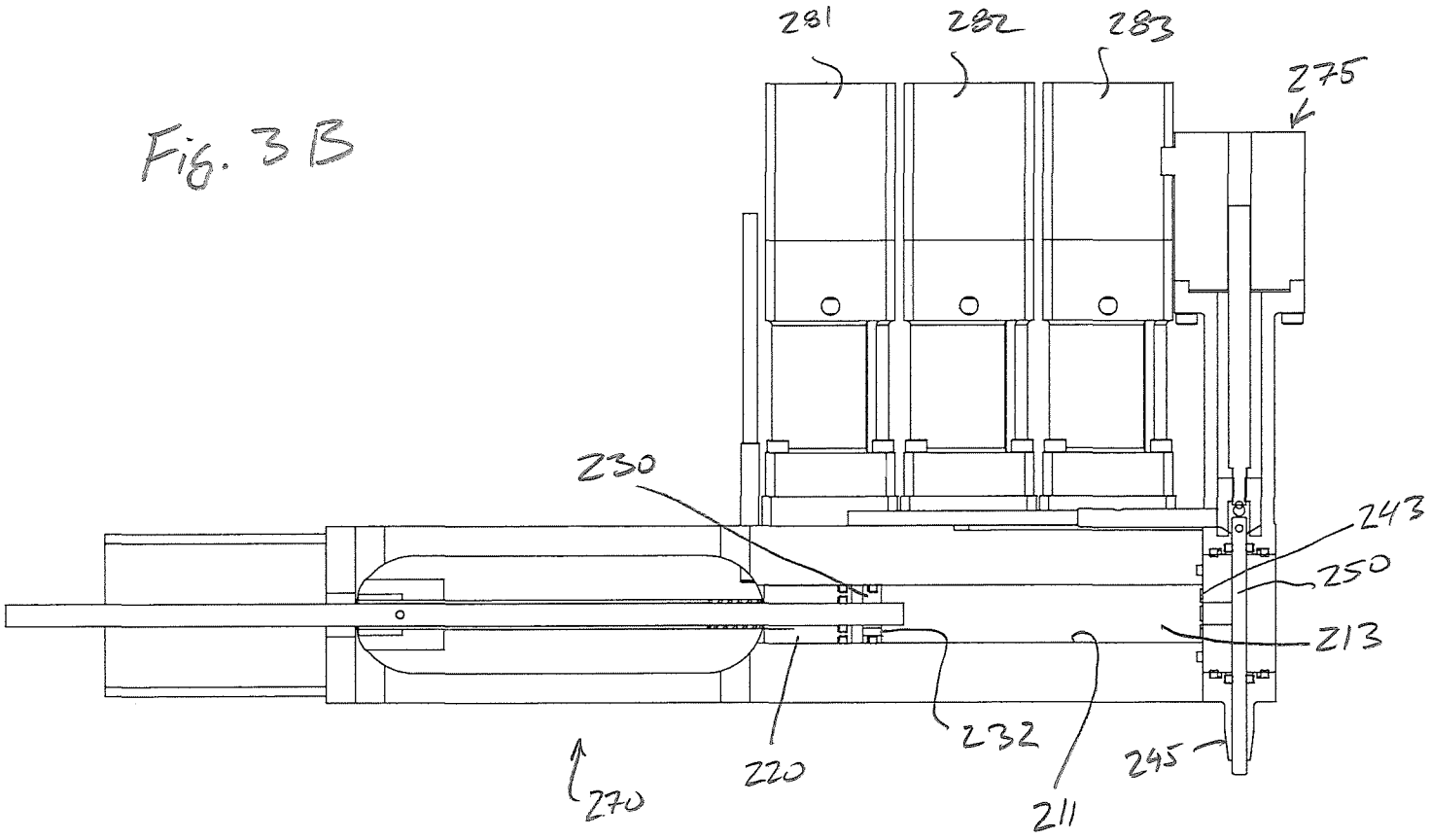

FIGS. 3A-3E show another preferred embodiment of a mixing and dispensing system. As shown in FIG. 3B, radially disposed inlet ports 243 (visible in FIG. 3B) are provided at the proximal end 17 of a cylindrical mixing volume 213, which is defined in part by the inner perimeter wall 211 of a housing 210. In this embodiment, six ingredient pumps are provided, and three of these pumps 281, 282 and 283 are visible in FIGS. 3A-3E. In alternative embodiments, more than six pumps may be provided. Not shown are the ingredient reservoirs associated with each pump. Cosmetic ingredients are introduced from the reservoirs through the inlet ports 243 for mixing in the mixing volume 213. Additional inlet ports (not shown) may also be provided and disposed around the entire circumference of the mixing chamber 213 near the proximal end 17. Also at the proximal end 17 of the housing 210 is an outlet port 245, which is oriented transversely to the longitudinal axis of the mixing volume 213. Each pump has a reservoir for urging the ingredient from the reservoir through the inlet port and into the mixing chamber. Also, it is preferred that a check valve be located between the pump and the corresponding inlet port, so that no fluid is forced into the inlet port from the mixing chamber.

Figure 3C:
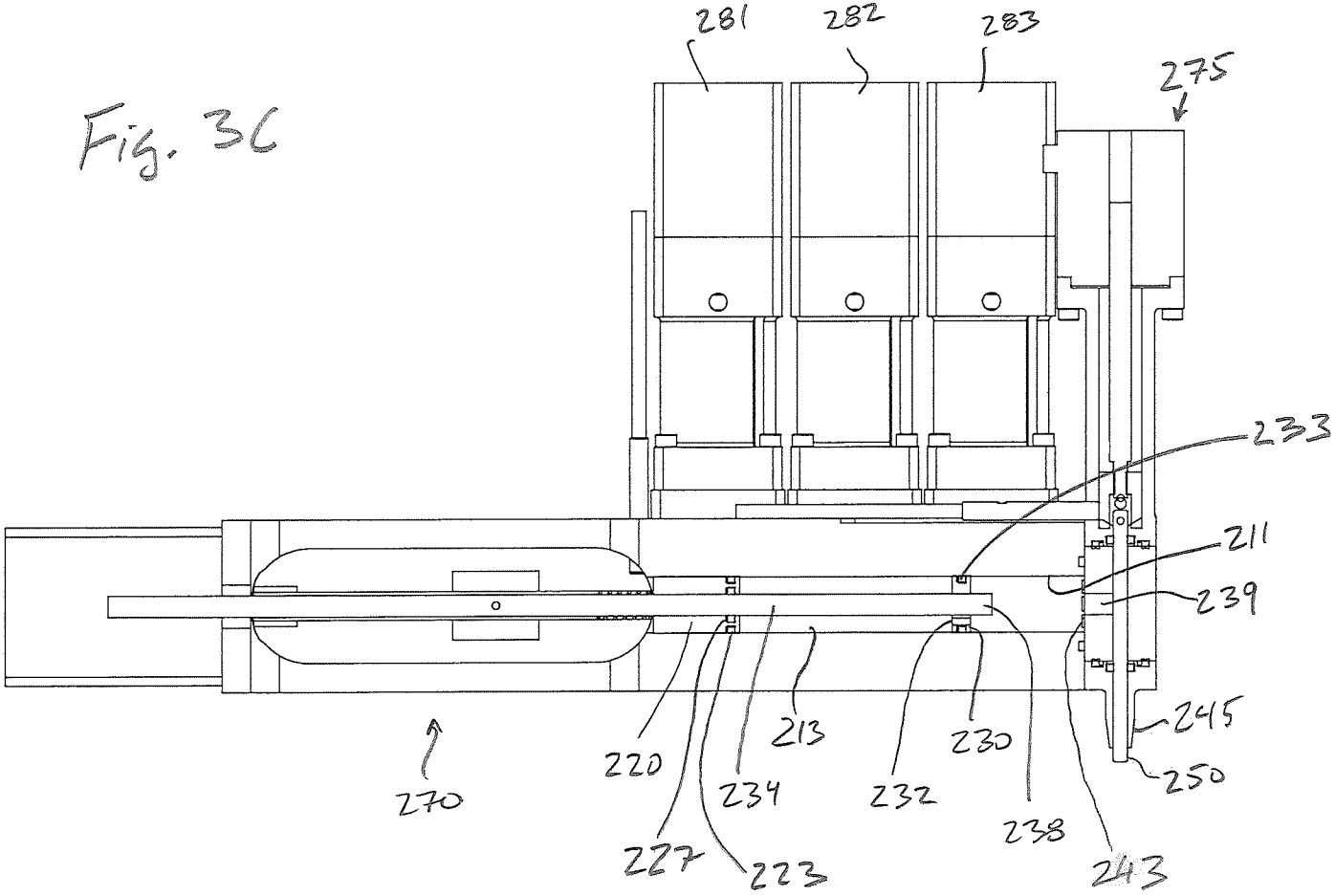
Figure 3D:
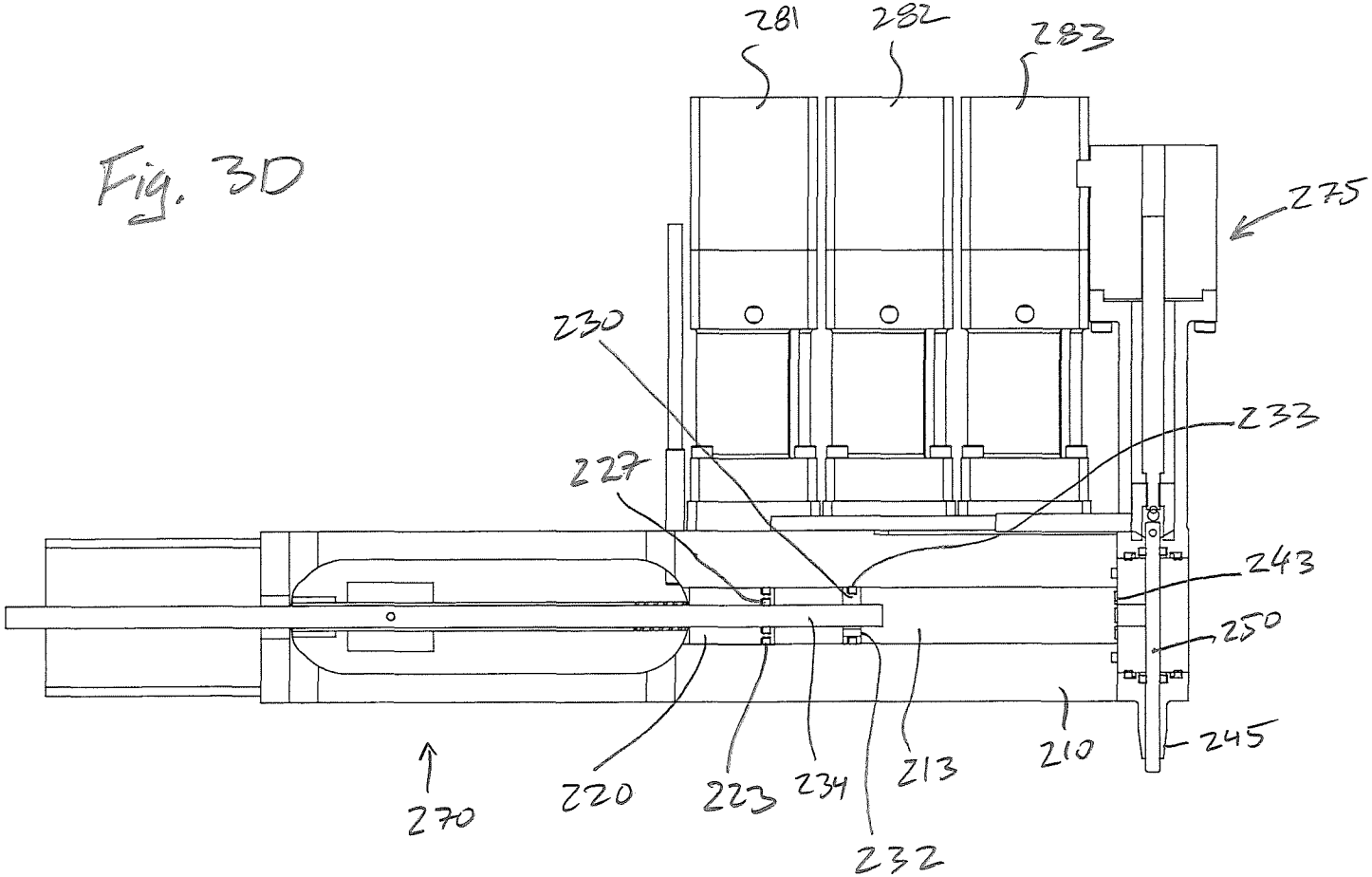

The mixing assembly includes a piston 220 and a dasher 230. An actuating system 270 is provided for moving the piston 220 and the dasher 230 back and forth, towards and away from the proximal end 17. A sealing pin 250 is oriented transversely to the longitudinal axis of the mixing chamber 213, so that it can pass through the outlet port 245. The sealing pin 250 has a uniform diameter along its working length, so that the sealing pin 250 can force fluid all the way through the outlet port 245 as well as seal the outlet port 245 closed. The sealing pin has an actuating system 275. As shown in FIGS. 3C and 3D, the dasher 230 has a rigid actuation rod 234 that fits within a central axial hole in the piston 220; this actuation rod 234 transmits the force from the actuation system 270 to the dasher 230.

The dasher 230 includes a mixing opening 232 through which fluid may pass from one side of the dasher 230 to the other. Gaskets 223 and 233 are provided about the outer diameters of the piston 220 and the dasher 230 so as to improve the seals with the inner perimeter wall 211. A gasket 227 is also provided along the inner diameter of the piston 220, so as to form a seal between the piston 220 and the dasher's actuation rod 234. These gaskets are preferably made of material that can withstand both the chemicals and the abrasives (e.g., iron oxide) in the cosmetic additives. Forming a seal between the inner perimeter wall 211 and the outer perimeter of the dasher 230 helps prevent an unmixed film of ingredients being left on the inner perimeter wall 211 after the mixing step, which helps achieve an evenly colored cosmetic product at the end of the process.

As noted above, the size of the dasher's mixing hole 232 and the speed at which the dasher 230 is agitated during the mixing step are optimized so that turbulent flow in the liquid is created at just above the laminar-turbulent transition, so that the ingredients are thoroughly mixed without breaking the ingredient emulsions down. In alternative embodiments, more than one mixing opening 232, or openings of various geometries may be provided in the dasher 230.

FIG. 3A shows the system at the beginning of a mixing and dispensing cycle. The sealing pin 250 is extended through the outlet port 245, while the piston 220 and the dasher 230 are extended to their greatest extent in the proximal direction so as to minimize or eliminate the size of the mixing volume. In FIG. 3B, the sealing pin 250 is kept within the outlet port 245, while the ingredients are introduced into the mixing chamber 213 from the inlet ports 243. The pumping of the ingredients from the reservoirs through the inlet ports 243 into the mixing chamber 213 causes the piston 220 and the dasher 230 to be urged toward the distal end 18. In FIGS. 3C and 3D, the sealing pin 250 is kept in the outlet port 245, while the dasher 230 is actuated back and forth within the mixing chamber 213 so as to thoroughly mix the ingredients and thereby form the final cosmetic product.

Figure 3E:
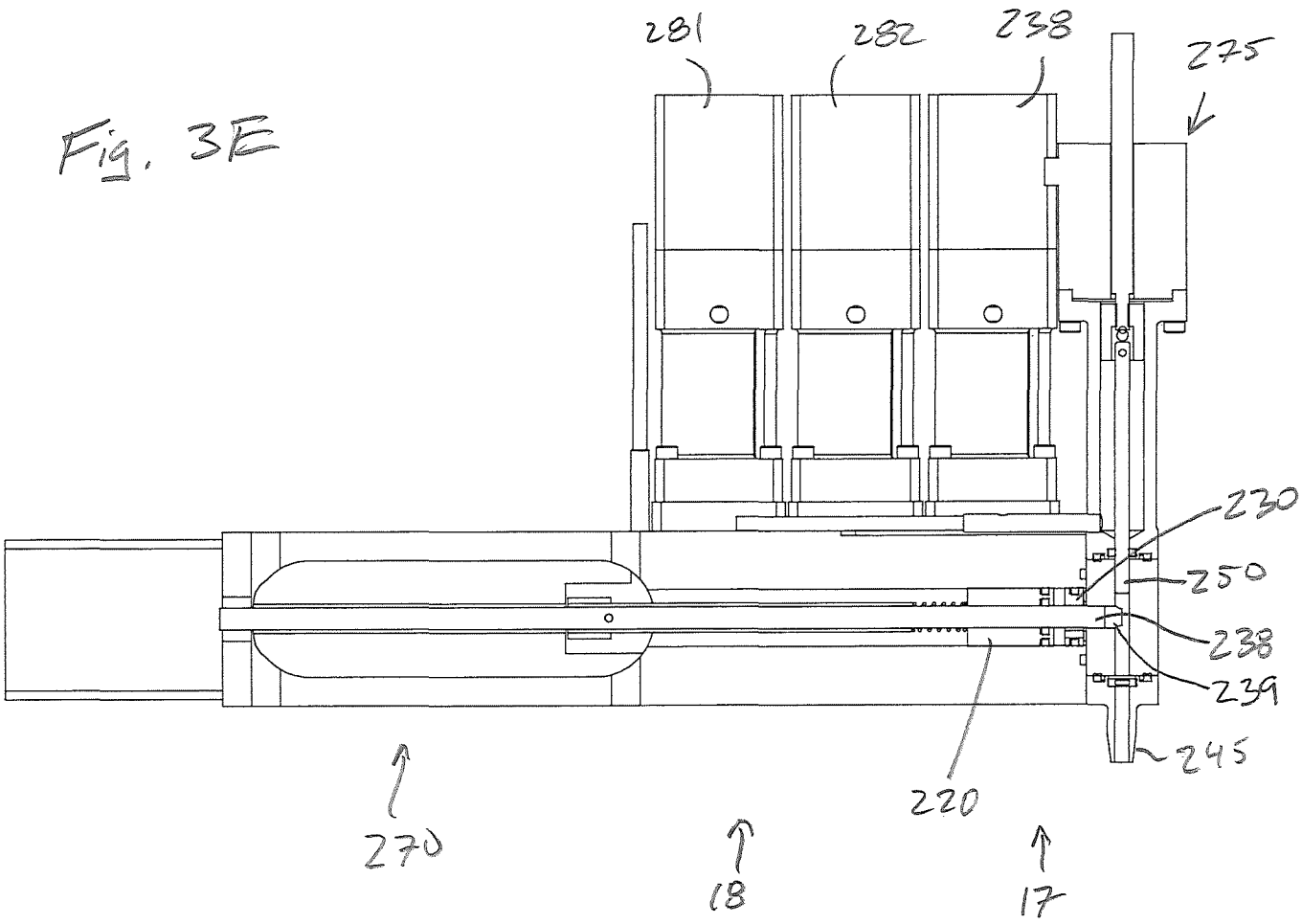

FIG. 3E shows that, after the mixing step, the sealing pin 250 is withdrawn from the outlet port 245, and the piston 220 is urged towards the proximal end 17 so as to force the mixed cosmetic product through the outlet port 245. The face of the dasher 230 includes a cylindrical protuberance 238 that is sized and shaped to force the cosmetic product out of the conduit 239 leading from the mixing chamber 213 to the outlet 245. After the mixing volume is minimized, the sealing pin 250 is moved down through the outlet port 245, so that the system returns to the arrangement shown in FIG. 3A. By urging the sealing pin 250 though the outlet 245, the remaining cosmetic product is urged completely through the outlet port 245 and out of the system.

The cycle may be repeated, with the same proportions of ingredients, until the desired amount of the cosmetic product is dispensed. Accordingly, this system can produce small batches and large batches of cosmetics. If a different cosmetic product is desired (having a different color, for example) the cycle may be repeated several times with different ingredients and/or different proportions of ingredients.

The mixing systems of the above-described embodiments are configured for precision dispensing. For example, to dispense a sample of from 3 microliters up to perhaps 10 milliliters or more, and thus to dispense 50 mL of product, the system might dispense a 10 mL amount 5 times.

Without limitation, potential subject matter that may be claimed (prefaced with the letter "P" so as to avoid confusion with the actual claims presented below) includes:

P1. A portioning machine for providing a cosmetic comprising a mixture of at least first and second ingredients, the portioning machine comprising: a mixing chamber, the mixing chamber having a longitudinal axis and an inner perimeter wall extending parallel to the longitudinal axis, the mixing chamber having a distal end and a proximal end; a first inlet for providing the first ingredient, the first inlet being in fluid communication with the mixing chamber; a second inlet for providing the first ingredient, the second inlet being in fluid communication with the mixing chamber; an outlet in fluid communication with the mixing chamber; a piston disposed in the mixing chamber and configured to move towards and away from the proximal end, the piston having a face extending transversely with respect to the longitudinal axis and being substantially in contact with the inner perimeter wall, such that the piston and the inner perimeter wall define a volume, and the face preventing flow of fluid therethrough into or out of the volume; a dasher disposed in the mixing chamber and configured to move towards and away from the proximal end in the volume, the dasher being configured to mix fluid in the volume and to permit the passage of fluid past a proximal end of the dasher; and a moveable sealing member configured to pass through the outlet so as to seal off fluid communication between the mixing chamber and the outlet and to urge fluid through the outlet.

P2. A portioning machine according to claim P1, wherein the dasher defines an opening through which fluid may flow from one side of the dasher to the other side of the dasher in the volume.

P3. A portioning machine according to claim P2, wherein the dasher is substantially in contact with the inner perimeter wall, so that a seal is formed between the dasher and the inner perimeter wall and fluid is forced to flow through the hole as the dasher moves in the volume towards and away from the proximal end.

P4. A portioning machine according to one of claims P2 and P3, wherein the dasher includes a second hole.

P5. A portioning machine according to one of claims P1-P4, wherein the moveable sealing member moves transversely to the longitudinal axis and is located at the proximal end.

P6. A portioning machine according to one of claims P1-P5, wherein each of the dasher and the piston are concentrically disposed about the longitudinal axis, wherein the dasher includes an actuating rod that is disposed in an axial passage defined by the piston.

P7. A portioning machine according to claim P1, wherein the sealing member is disposed in the mixing chamber and is configured to move in the volume towards and away from the proximal end, the sealing member being configured to further seal off fluid communication between the mixing chamber and the first inlet and the second inlet.

P8. A portioning machine according to claim P7, wherein each of the sealing member, the dasher and the piston are concentrically disposed about the longitudinal axis, wherein the sealing member is disposed inside of the dasher, and the dasher is disposed in the piston.

P9. A portioning machine according to one of claims P1, P2, P7 and P8, wherein the face of the piston is shaped so that the dasher can nest in the face and form a flat end wall in combination with the piston face.

P10. A portioning machine according to one of claims P1-P9, wherein as the piston moves in a distal direction the volume increases and as the piston moves in a proximal direction the volume decreases, and wherein the first inlet, the second inlet and the outlet are disposed adjacent the proximal end of the chamber.

P11. A portioning machine according to one of claims P1-P10, further including a third inlet for providing a third ingredient, the third inlet being in fluid communication with the mixing chamber P12. A method of mixing first and second ingredients to form a cosmetic, the method comprising: providing a portioning machine according to one of claims P1-P11; moving the piston towards the distal end and introducing the first and second ingredients from the first and second inlets respectively into the volume; moving the dasher in the volume so as to cause the mixing of the first and second ingredients in the volume; moving the sealing member so as to unseal the outlet; and moving the piston towards the proximal end so as to force the mixed first and second ingredients out of the outlet.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A portioning machine for providing a cosmetic comprising a mixture of at least first and second ingredients, the portioning machine comprising:

a mixing chamber, the mixing chamber having a longitudinal axis and an inner perimeter wall extending parallel to the longitudinal axis, the mixing chamber having a distal end and a proximal end;

a first inlet for providing the first ingredient, the first inlet being in fluid communication with the mixing chamber;

a second inlet for providing the second ingredient, the second inlet being in fluid communication with the mixing chamber;

an outlet in fluid communication with the mixing chamber;

a piston disposed in the mixing chamber and configured to move towards and away from the proximal end, the piston having a face extending transversely with respect to the longitudinal axis and being substantially in contact with the inner perimeter wall, such that the piston and the inner perimeter wall define a volume, and the face preventing flow of fluid therethrough into or out of the volume;

a dasher disposed in the mixing chamber and configured to move towards and away from the proximal end in the volume, the dasher being configured to mix fluid in the volume and to permit the passage of fluid past a proximal end of the dasher; and a moveable sealing member configured to pass through the outlet so as to seal off fluid communication between the mixing chamber and the outlet and to urge fluid through the outlet.

2. A portioning machine according to claim 1, wherein the dasher defines an opening through which fluid may flow from one side of the dasher to the other side of the dasher in the volume.

3. A portioning machine according to claim 2, wherein the dasher is substantially in contact with the inner perimeter wall, so that a seal is formed between the dasher and the inner perimeter wall and fluid is forced to flow through the opening as the dasher moves in the volume towards and away from the proximal end.

4. A portioning machine according to claim 3, wherein the dasher includes a second opening.

5. A portioning machine according to claim 3, wherein the moveable sealing member moves transversely to the longitudinal axis and is located at the proximal end.

6. A portioning machine according to claim 5, wherein each of the dasher and the piston are concentrically disposed about the longitudinal axis, wherein the dasher includes an actuating rod that is disposed in an axial passage defined by the piston.

7. A portioning machine according to claim 6, wherein as the piston moves in a distal direction the volume increases and as the piston moves in a proximal direction the volume decreases, and wherein the first inlet, the second inlet and the outlet are disposed adjacent the proximal end of the chamber.

8. A portioning machine according to claim 7, further including a third inlet for providing a third ingredient, the third inlet being in fluid communication with the mixing chamber.

9. A portioning machine according to claim 1, wherein the sealing member is disposed in the mixing chamber and is configured to move in the volume towards and away from the proximal end, the sealing member being configured to further seal off fluid communication between the mixing chamber and the first inlet and the second inlet.

10. A portioning machine according to claim 9, wherein each of the sealing member, the dasher and the piston are concentrically disposed about the longitudinal axis, wherein the sealing member is disposed inside of the dasher, and the dasher is disposed in the piston.

11. A portioning machine according to claim 10, wherein as the piston moves in a distal direction the volume increases and as the piston moves in a proximal direction the volume decreases, and wherein the first inlet, the second inlet and the outlet are disposed adjacent the proximal end of the chamber.

12. A portioning machine according to claim 10, wherein the face of the piston is shaped so that the dasher can nest in the face and form a flat end wall in combination with the piston face.

13. A portioning machine according to claim 11, further including a third inlet for providing a third ingredient, the third inlet being in fluid communication with the mixing chamber.

14. A method of mixing first and second ingredients to form a cosmetic, the method comprising:

providing a portioning machine according to claim 1;

moving the piston towards the distal end and introducing the first and second ingredients from the first and second inlets respectively into the volume;

moving the dasher in the volume so as to cause the mixing of the first and second ingredients in the volume;

moving the sealing member so as to unseal the outlet; and moving the piston towards the proximal end so as to force the mixed first and second ingredients out of the outlet.

* * * * *